US005267463A

United States Patent [19]

Doyama

[11] Patent Number: 5,267,463

[45] Date of Patent: Dec. 7, 1993

[54] AUTOMATIC TRANSFER APPARATUS FOR USE IN A FORGING PRESS

[75] Inventor: Yoshihiro Doyama, Osaka, Japan

[73] Assignee: Kurimoto, Ltd., Osaka, Japan

[21] Appl. No.: 889,353

[22] Filed: May 28, 1992

[30] Foreign Application Priority Data

Sep. 30, 1991 [JP] Japan ..... 3-280848

[51] Int. Cl.[5] ..... B21D 43/05

[52] U.S. Cl. ..... 72/405; 198/621

[58] Field of Search ..... 72/405, 421; 198/621

[56] References Cited

U.S. PATENT DOCUMENTS 3,760,957 9/1973 Berger ..... 198/621
3,771,669 11/1973 Maggioni ..... 198/621
4,462,521 7/1984 Takagi ..... 198/621
4,589,819 5/1986 Shirao ..... 72/405
4,873,860 10/1989 Werner ..... 198/621

*Primary Examiner*—Daniel C. Crane

*Attorney, Agent, or Firm*—Jones, Tullar & Cooper

[57] ABSTRACT

To apply exactly a variety of operating patterns to an automatic transfer apparatus for use in a forging press, an arrangement is proposed comprising: intermediate frames each mounted on an external frame so as to move freely up and down; a clamp frame mounted on the intermediate frame so as to move freely in a lateral direction; a pair of beams mounted on the clamp frame so as to open and close freely; servo motors for performing upward and downward motion, lateral motion and opening-and-closing motion; and drive control equipment. The operation patters are inputted to a microcomputer for picture processing and displayed. Accordingly, the driving operations are exactly controlled by pulse signals and feedback pulses of the servo motors. The arrangement is applicable to various types of motions. Feed motion being of the longest stroke is linear and therefore positioning becomes accurate. The construction is advantageous in accomplishing a small-sized and light-weight automatic transfer apparatus.

20 Claims, 9 Drawing Sheets

B-B

C-C

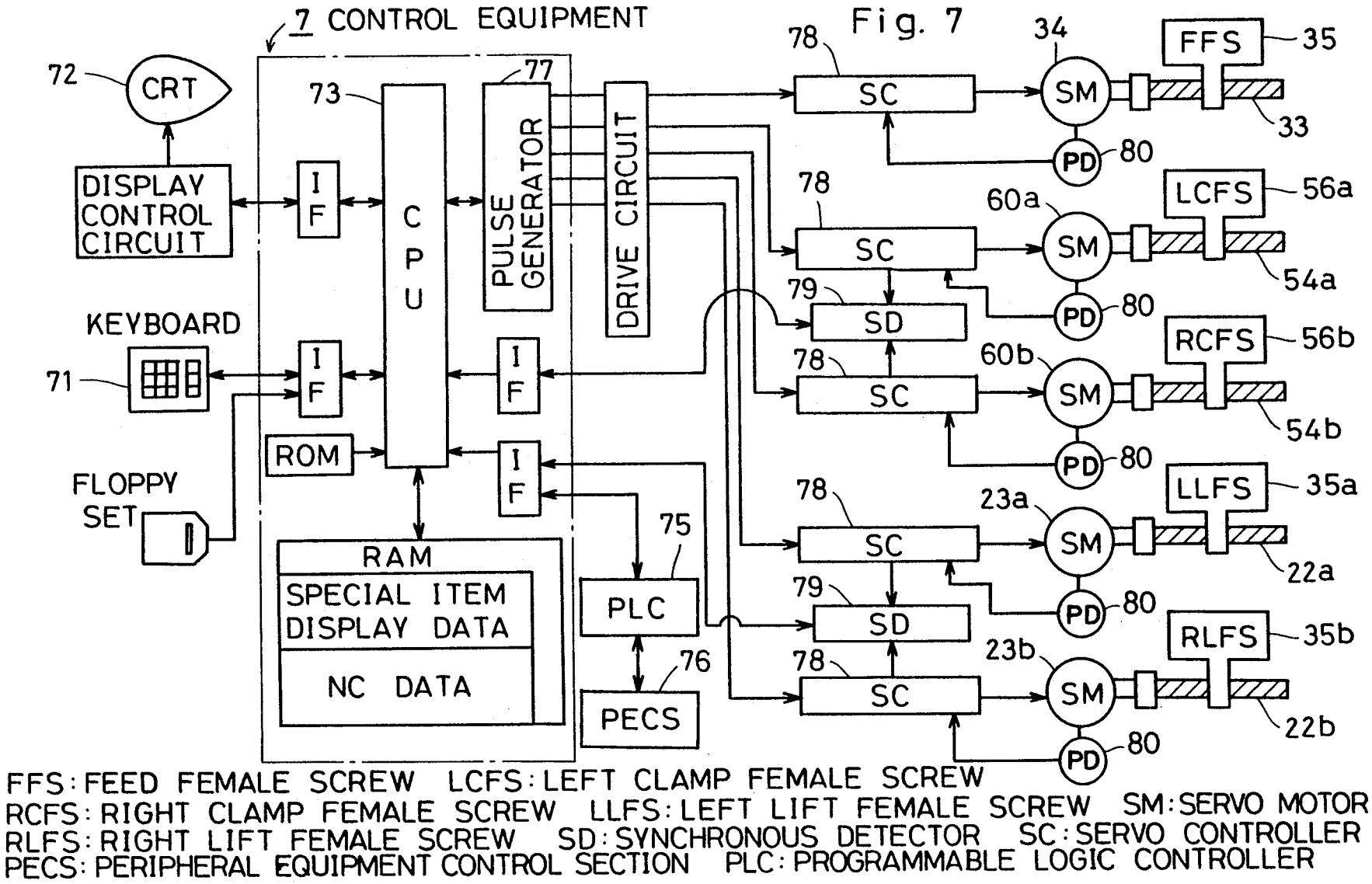
Fig. 7
7 CONTROL EQUIPMENT
FFS
LCFS
RCFS
LLFS
RLFS
35
33
56a
54a
56b
54b
35a
22a
35b
22b
SM
PD
80
34
60a
60b
23a
23b
SC
SD
78
79
DRIVE CIRCUIT
PULSE GENERATOR
77
C P U
73
I F
ROM
RAM
SPECIAL ITEM DISPLAY DATA
NC DATA
PLC
75
PECS
76
CRT
72
DISPLAY CONTROL CIRCUIT
KEYBOARD
71
FLOPPY SET
FFS: FEED FEMALE SCREW LCFS: LEFT CLAMP FEMALE SCREW
RCFS: RIGHT CLAMP FEMALE SCREW LLFS: LEFT LIFT FEMALE SCREW
RLFS: RIGHT LIFT FEMALE SCREW SD: SYNCHRONOUS DETECTOR
PECS: PERIPHERAL EQUIPMENT CONTROL SECTION PLC: PROGRAMMABLE LOGIC CONTROLLER
SM: SERVO MOTOR
SC: SERVO CONTROLLER

Fig. 9

ANGLE-STROKE SETTING TABLE

| OPERATION | | START | END | STROKE |
|---|---|---|---|---|
| FEED | ADVANCE | 155° | 265° | 230.0mm |
| | RETURN | 335° | 85° | |
| LIFT | LIFT | 120° | 170° | 60.0mm |
| | DOWN | 250° | 300° | |
| CLAMP | CLOSE | 60° | 120° | 100.0mm |
| | OPEN | 280° | 0° | |

| |
|---|
| PROGRAM No 2 |
| CYCLE TIME 2.4 sec |
| PRESS START ANGLE 300° |
| |

SELECT MODE

1. DATE CORRECTION 2. DATE READ-IN 3. STROE IN FLOPPY

E. OPERATION

DISPLAY BY SPACE KEY LIST CHANGE

AUTOMATIC TRANSFER APPARATUS FOR USE IN A FORGING PRESS

BACKGROUND OF THE INVENTION

1. Field of the Invention

The present invention relates to an automatic transfer apparatus for use in a forging press which picks up or clamps a work and transfers it according to a sequential order of the press working cycle.

2. Prior Arts

A typical transfer mechanism has been heretofore known and put into practical use, in which two beam drivers are provided respectively on the left and right sides of a forging press, and three-directional motions, i.e., vertical motion (lift), advance and return (feed), and opening-and-closing motion (clamp) are combined and applied to two beams disposed for connecting horizontally the two beam drivers and putting them between an upper and lower mold, whereby a work clamped between clamping fingers attached inwardly of both beams are transferred and placed at a required place.

It is necessary for the mentioned beam drivers to repeat the above three motions exactly in sequential order so as to be in synchronous with the working operations of the press and, therefore, a transmission mechanism formed in association with control equipment, a tooth gear, a rack, a connecting rod, etc. for receiving rotation of a crankshaft of the press main body is used for conversion to motion of the beams.

A problem, however, exists in that since the association among disc cams, gears, racks, etc. is fixed in such a mechanism, the stroke, timing and speed of the mechanism are quite limited to values within a certain narrow range, and it is not allowed to change the values appropriately according to the size, kind, etc. of the work, resulting in several restrictions or disadvantages in the practical use of the mechanism except large size automatic forging presses with less variation in the work to be processed.

That is, in the widely used transfer type forging press, the work to be processed is thereby of many kinds while the respective amount to be processed is rather small. Accordingly, for performing necessary movements of the beams by means of such a fixed type transfer machine, the arrangement of molds is changed or the fingers mounted on the beams are replaced to overcome the above problem. Such a change or replacement, however, brings about another problem of a decrease in productivity and an increase in complexty of maintenance. A further problem exists in that because of the complicated mechanism combination using a large number of components of high rigidity, the beam drivers are obliged to be large-sized respectively occupying a large space on both the left and right sides of the forging press.

To overcome the above problems, several attempts have been proposed so far, as disclosed in FIGS. 10 and 11 transcripted from Japanese Laid-Open Patent Publication No. 63-215330.

Referring to FIG. 10, servo assistors 101, 102, 103, 104, 105 of the electrical hydraulic type are disposed respectively on three shafts for driving the beams, and thus the three output shafts operated hydraulically by the servo assistors form respectively control shafts 108, 109, 110 for vertical, lateral and opening-and-closing motions of the transfer beams 106, 107. Referring now to FIG. 11, in the servo assistor of the electrical hydraulic type, a driving force is applied from a step motor 111 to a piston cylinder 113 through a control valve 112, and a piston 114 has a piston rod 116 provided with teeth 115 which cooperates with a pinion 117 for feedback of the actual value. Thus, piston rod 116 being an output shaft performs also as a control shaft for driving the transfer beams among three axes. When driving the motor 111, the control valve 112 is displaced with respect to a fixed spindle 119 of the pinion 117 by means of the lateral beam 118, whereby valves 120A, 120B are open to connect cylinder chambers 121A, 121B to the pressure feeder and tank, thus the piston 114 being moved by pressure differential. In effect, the piston rod being an output shaft and also a control shaft acts directly on a mechanical section associated with it through the mechanism control valves for setting mechanical target values, serving as a rack and as a servo assisting section, and as a pinion mechanism.

It is certain that the prior art shown in FIGS. 10 and 11 improves, to a certain extent, transfer motions, and achieves variation in momentum, variation in the relation between one motion axis and the other, and variation in velocity of individual motion axes corresponding to the size of the work or working ratio.

As shown in FIG. 10, however, in the mechanism of this prior art, the control shafts 108, 109 of the servo assistors 101 and 102 perform a vertical linear motion or vertical movement (lift) only, but as for the advance and return (feed) which needs the longest stroke, the linear motion of the control shaft 110 in the servo assistor 103 is converted to rotational motion on the pin 122, which serves as a fulcrum, which motion is transmitted to the transfer beams 106, 107, and those beams turn tracing a locus not horizontally linear but of a large circular arc with respect to the lower mold. That is, not only the horizontal distance but also the vertical distance is involved in the motion of the beams and, as a result, synchronous motion and positional relation in the molds are complicated due to such involvement of other factors. The influence of such a complication is more serious when the feed distance is larger.

Moreover, the control shaft is driven by opening and closing the valve 112, and this movement is directly transmitted to respective mechanical sections through mechanical functions of the rack and pinion, and mechanism for setting target values is mechanically performed. As a result, starting and stopping of the control shaft are performed instantaneously only by mechanical engagement and disengagement of related members. As is well known, if a driving force is repeatedly applied to a shaft in a continuous and regular manner and suddenly stopped at a required position by braking means such as a rack, a considerably large impact force will act on the shaft due to inertial, eventually resulting in accumulation of metal fatigue on the shaft. To prevent such a problem, a large safety factor is estimated for the shaft. However, for the purpose of associating many kinds of motions requiring complicated interlock of the shaft, a driving system as a whole is obliged to be large-sized and heavy-weighted. Furthermore, in the mechanism according to this prior art, many hydraulic mechanisms and pipings therefor are complicatedly incorporated and, accordingly, maintenance under unavoidable operating conditions such as vibration is very troublesome, and perfect maintenance actually difficult to achieve.

SUMMARY OF THE INVENTION

An object of the present invention is to solve the above-discussed problems, having a transfer apparatus capable of freely and exactly controlling transfer of the work according to the size and machining requirement of the work as well as to conditions of the molds, and in which operating conditions such as start, stop, etc. are freely set by small size and light weight drivers.

In order to accomplish the forgoing object, a beam driver incorporated in an automatic transfer apparatus for use in a forging press in accordance with the present invention comprises a hollow square-shaped intermediate frame mounted, so as to be freely movable in a vertical direction, on an external frame fixed to a press body; a clamp frame disposed so as to be freely movable in a lateral direction within the intermediate frame; a pair of beams mounted on the clamp frame so as to be freely turnable; and servo motors each for providing vertical, lateral and opening-and-closing driving motions; each servo motor being capable of starting necessary drive and stopping it by means of control equipment which generates pulse signals according to initially inputted operating conditions.

In the automatic transfer apparatus for use in the forging press of the above construction, since the feed motion of the beams is arranged by the clamp beams laterally moving in a horizontal direction within the intermediate frame, for performing a feed (return and advance) of the longest stroke, each beam moves in parallel to molds so as to keep a required distance from the molds quite accurately. In effect, this feed motion, in association with a lift motion and a clamp motion, assures very exact transfer operations as compared with the prior art.

Essential members for driving this feed motion are the servo motors and male screw-threaded shafts for transmitting rotation of each servo motor. Drive is controlled by a pulse signal thereby achieving a high level delicate drive control. To perform control in association with a servo motor and screw-threaded shaft with a pulse signal is known, but by incorporating such an associated mechanism in a transfer apparatus, it is now possible by the invention to establish a program of speed control for soft starts and soft stops thereof. Such a control is easily achieved by setting and commanding an optimum velocity change either by damping of the pulse duration or by an increase or decrease of the quiescent time of the pulse.

It is also preferable to dispose a comparator which receives feedback pulses returned from a pulse generating encoder mounted on each of the two servo motors and compares them to check whether or not they are synchronous, because the transfer apparatus must exactly synchronize the motions of a pair of beams by a mechanism for performing pulse control of two servo motors.

In the transfer apparatus of the above construction, pulses are subject to arithmetic control according to a desired operation pattern stored in a microcomputer and, therefore, every necessary operation can be easily selected by a simple instruction of inputting working conditions (numeric values of cycle time, starting and ending points of three directional motions, etc.) suitable for shape of work, mold, etc.

The transfer apparatus of the above construction and function is adaptable to any difference in size and/or shape of the work, degree of working requirement, etc. in forging press engaged in the production of many kinds but small quantity of products, and achieves accurate transfer of each work to a required position. Further, the transfer apparatus can be small-sized, lightweight and, therefore, occupies a smaller space. Furthermore, since the number of components and parts are decreased and no complicated piping is needed being different from hydraulic devices, troublesome maintenance under vibration peculiar to forging is remarkably reduced, resulting thereby in productivity improvement.

Other objects, features and advantages of the invention will become apparent in the course of the following description with reference to the accompanying drawings.

BRIEF DESCRIPTION OF THE DRAWINGS

In the drawings forming a part of the present application,

FIG. 7 is a block diagram showing a control mechanism in accordance with the invention;

FIG. 9 shows another example of a picture on a CRT display;

DESCRIPTION OF THE PREFERRED EMBODIMENT

An embodiment of the present invention is hereinafter described with reference to FIGS. 1 to 5.

Figure 1:
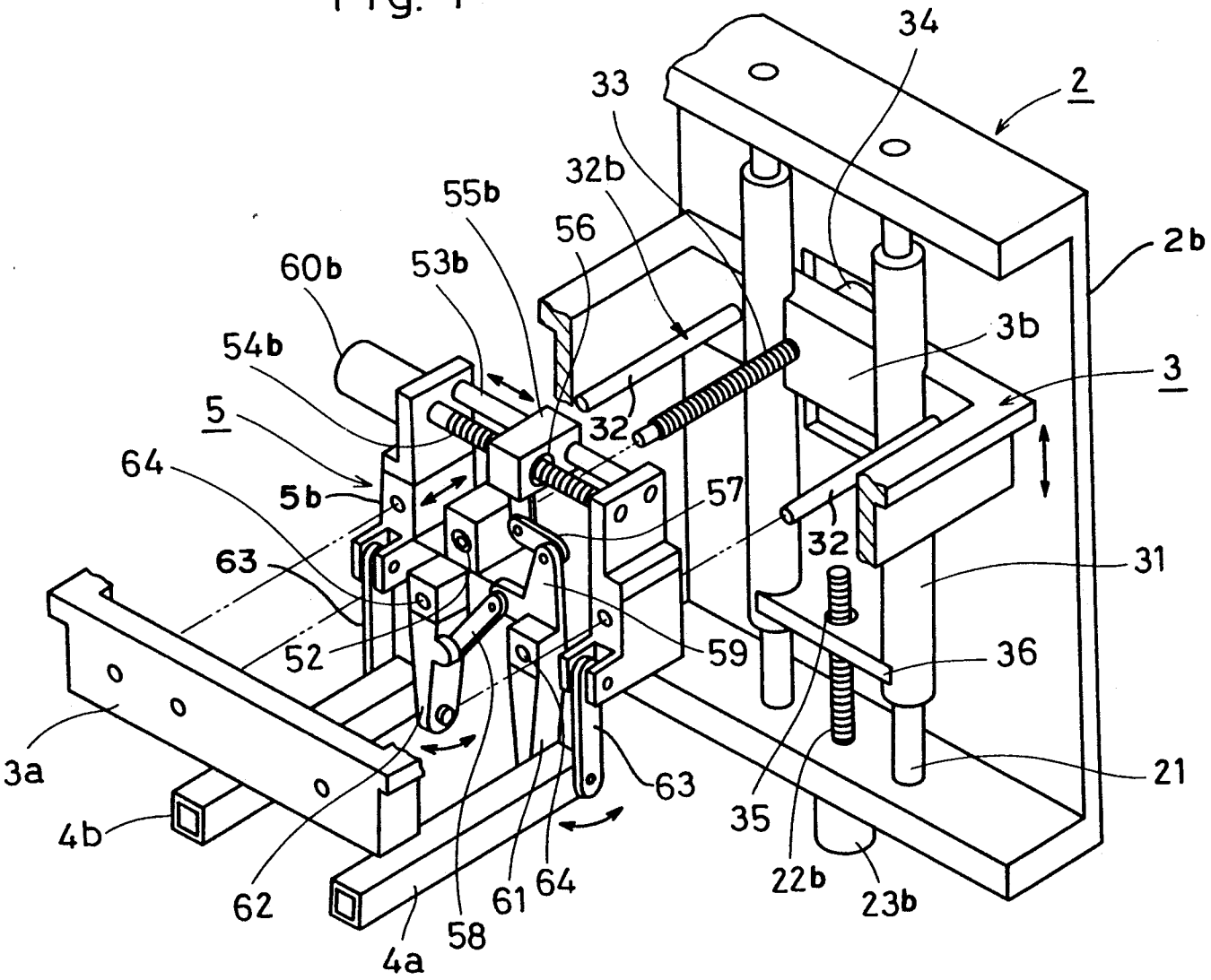
FIG. 1 is a perspective view showing an embodiment in accordance with the present invention.

FIG. 1 is a schematic perspective view showing a construction of an embodiment of the invention. In the drawings, an external frame 2 is fixed to a press main body 1 shown in FIG. 3. The external frame 2 has two sides 2*a* and 2*b*. Two long lift rods 21 each like a bar are vertically disposed in parallel to each other on each frame side. Two long cylindrical lift guides 31 respectively coupled with an intermediate frame 3 are slidably mounted respectively from the outside on the two lift rods 21. A female screw 35 is formed at the center of a lateral member 36 connecting the two lift guides 31, and a male screw-threaded shaft 22*b* to be mated with the female screw 35 is connected to a servo motor 23*b* disposed below the frame 2 for lift drive. That is, the intermediate frame 3, being supported by the lift guides 31 for sliding movement on the lift rods 21, performs a lift motion (up and down) in the vertical direction.

Figure 2:
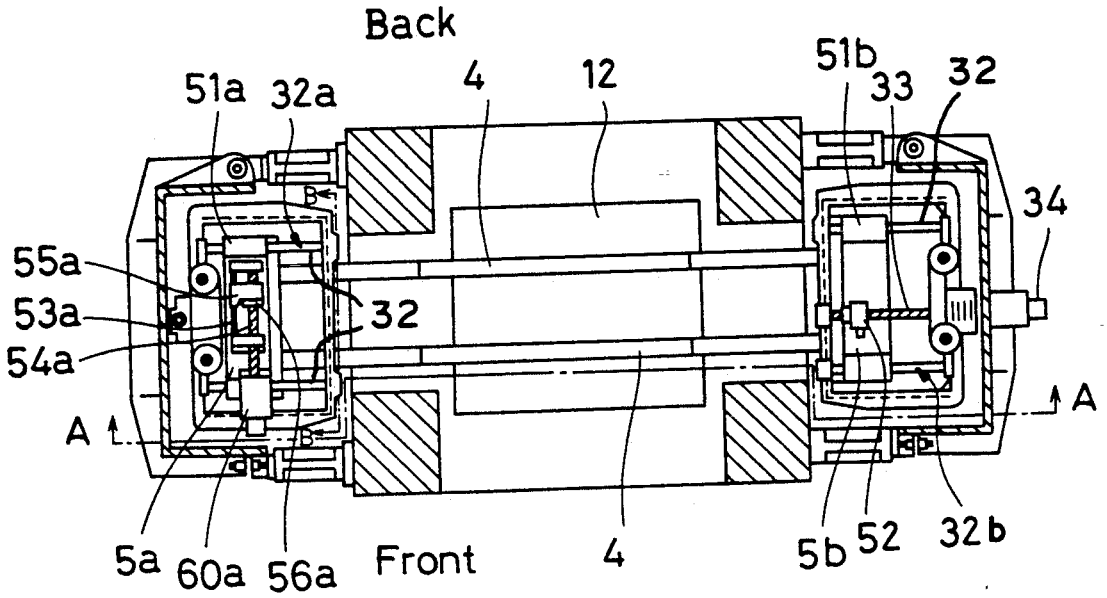
FIG. 2 is a plan view of the same embodiment.

The intermediate frame 3 is formed of a square-shaped member having four sides, and in which the two lift guides 31 extending vertically are secured to one side, and two feed guide rods 32 are disposed in parallel between the opposed sides 3*a*, 3*b*. As shown in FIG. 2, in the intermediate frame side 3*b* on the right side, a male screw-threaded feed shaft 33 is rotatably disposed between the two feed guide rods 32, and is connected to a servo motor 34 for feed drive disposed outside of the intermediate frame side 3*b*. The servo motor 34 extends out of an opening formed by cutting out the external frame side 2*b*. It is noted that the intermediate frame side 3*a* on the left side of the press body 1 is not provided with either a male screw-threaded feed shaft 33 nor a servo motor 34.

The two feed guide rods 32 extend slidably through a clamp frame 5 to support it inside of the intermediate frame 3. The clamp frame 5 shown in FIG. 1 is designated clamp frame 5*b*.

As shown in FIG. 2, a female feed screw 52 is formed in the clamp frame 5*b* on the right side of the press body 1. When rotating the servo motor 34 for feed drive, the clamp frame 5*b* starts a leftward and then a rightward feed motion (advance and return), whereby beams 4 supported below the clamp frame 5*b* through respective links and levers is moved to transmit a moving force to the clamp frame 5*a* on the left side connected to the beams 4.

The clamp frame 5*a* on the left side causes the two feed guide rods 32 to move slidably, thereby performing an advance and return feed motion.

As shown in FIG. 1, in the clamp frame 5, a clamp rod 53*b* and a male screw-threaded clamp shaft 54*b* are provided and extend through a slider 55*b* in parallel with each other to two support ends. One end of the male screw-threaded clamp shaft 54*b* is connected to a servo motor 60*b* for clamp drive. In the slider 55*b*, a female screw 56 is formed for engagement with a slide bearing of the clamp rod 53*b* and with the male screw-threaded clamp shaft 54*b*. The lower part of the slider is connected to a lateral link 57 through a pin.

Fulcrum pins 64 are longitudinally disposed respectively on the lower side of the clamp frame 5 facing the press body 1, and on which front lever 61 and rear lever 62 are provided so as to turn within a vertical plane. An upper lever 59 is formed into a fork divergent at a right angle on the fulcrum pin 64, and one arm of the upper lever 59 is connected to the lateral link 57 while the other arm is connected to an inclined link 58 each through a pin. The end of the inclined link 58 is connected to the rear lever 62 below the fulcrum pin 64 through a pin.

Auxiliary levers 63 are respectively connected by a pin to two lower side ends of the clamp frame 5 facing the press body so as to be oscillated forward and backward. Each lower end of the auxiliary levers 63, together with the lower ends of the front lever 61 and the rear lever 62, is connected to a respective beam 4 each through a pin so as to be oscillated forward and backward. When moving the slider 55*b* forward by driving the servo motor 60*b* for clamp drive for example, the lateral link 57 causes the upper lever 59 to move forward, whereby the beam 4 (front side in FIG. 1) connected to the lower end of the front lever 61 moves backward oscillating around the fulcrum pin 64. On the other hand, when the upper level 59 moves forward, the inclined link 58 is raised, whereby the beam 4 (back side in FIG. 1) connected to the lower end of the rear level 62 through a pin is caused to move forward. That is, the two beams move in such a manner as to come near each other, thus performing a clamping motion.

Figure 3:
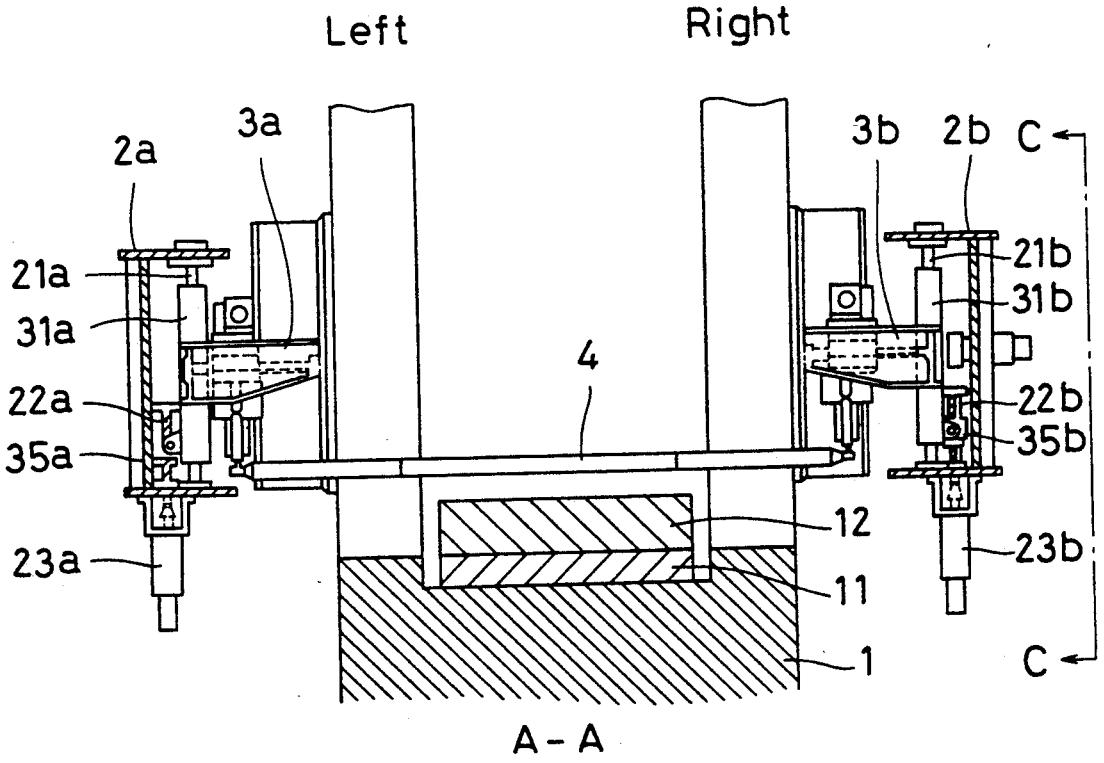
FIG. 3 is a view taken along the line A—A in FIG. 2.
Figure 4:
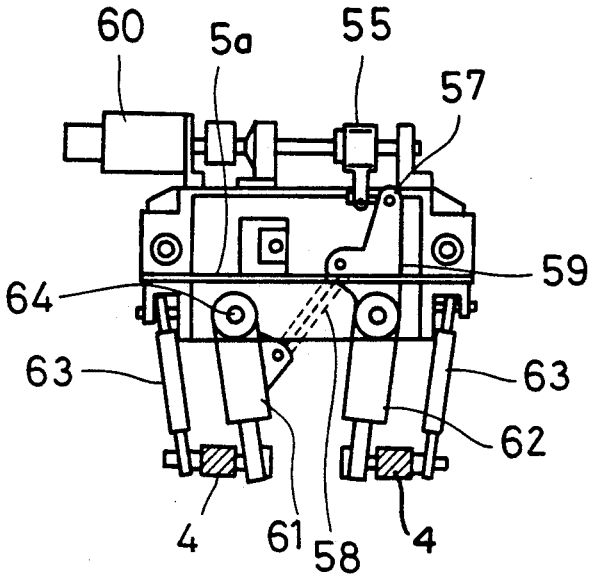
FIG. 4 is a view taken along the line B—B in FIG. 2.
Figure 5:
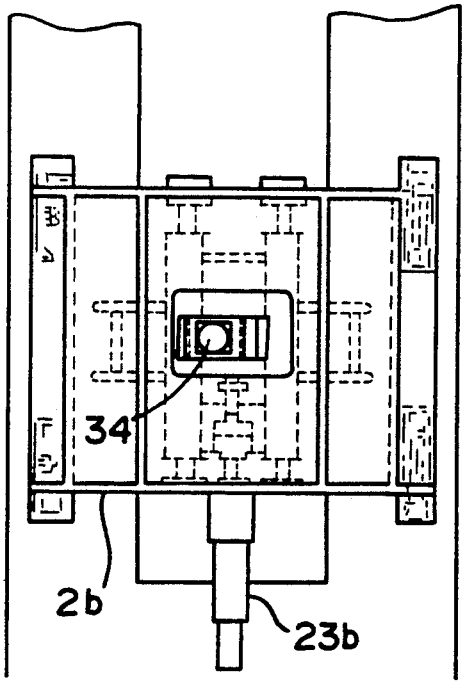
FIG. 5 is a view taken along the line C—C in FIG. 3.

In addition, FIG. 4 shows the clamp construction in detail taken along the line B—B of FIG. 2, and FIG. 5 shows a side view of the clamp construction taken along the line C—C of FIG. 3.

Figure 6:
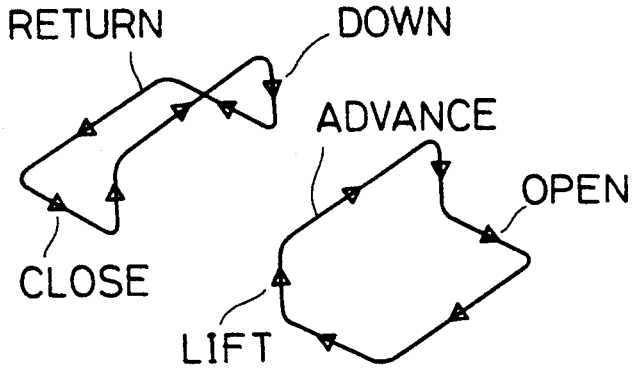
FIG. 6 shows locus of beam motion.

FIG. 6 shows the locus of movement of the beams for synchronizing three directions of movement by the transfer apparatus according to the invention, and in which the lift motion comprises as up and down motion, the feed motion comprises an advance and return motion, and the clamp motion comprises a clamp and open (unclamp), respectively.

FIG. 7 is a block diagram of the control function showing the control system according to the invention.

The automatic transfer apparatus according to the invention is provided with five servo motors (34, 60*a*, 60*b*, 23*a*, 23*b*) connected to five male screw-threaded shafts (33, 54*a*, 54*b*, 22*a*, 22*b*).

For rotation of each servo motor, pulse signals generated by a pulse generator 77 of the control equipment 7 are outputted to a servo controller 78, whereby required rotation is performed according to instruction imparted by the pulse signal. Actual rotational numbers of the servo motors are detected and returned from a pulse detector (PD) 80 incorporating an encoder for pulse generation in the form of a feedback pulse. A signal is then inputted from the servo controller 78 to a CPU 73 of the control equipment 7 to detect dissociation by comparison, and operating instructions are outputted again in the form of a pulse signal.

In case of two servo motors requiring an identical control, a synchronous detector 79 is disposed between the two servo controllers 78 to acknowledge coincidence of the pulse signals, and if not, occurrence of such an abnormal state is fed back to a programmable logic controller 75 by way of the CPU 73 to inform an operator through related peripheral equipment controller 76 of the press and others.

The main body of the control equipment 7 is a microcomputer comprising the central processing unit CPU 73, ROM, RAM, pulse generator 77 of a flip-flop circuit and a necessary interface IF.

Figure 8:
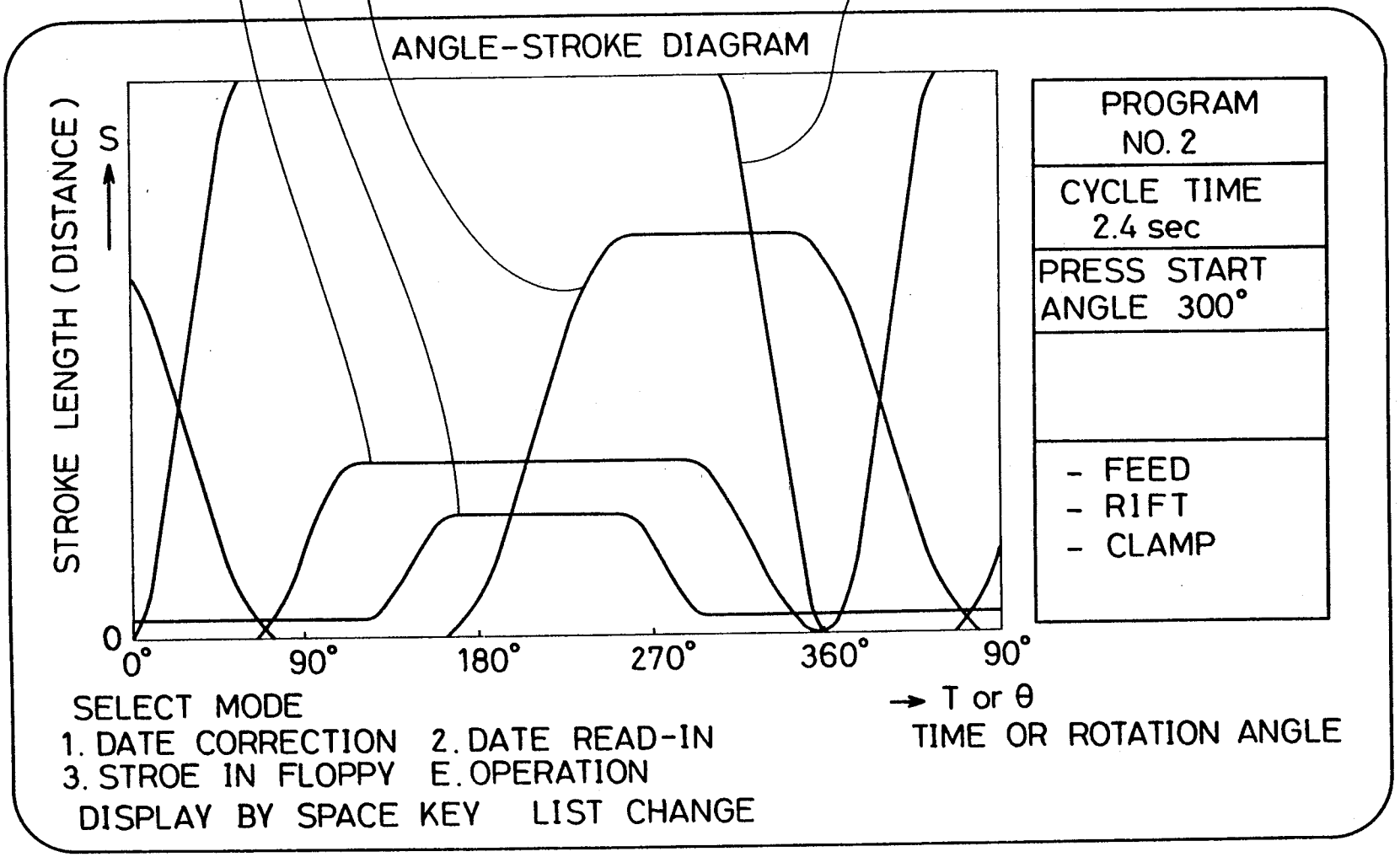
FIG. 8 shows an example of a picture on a CRT display.
Figure 10:
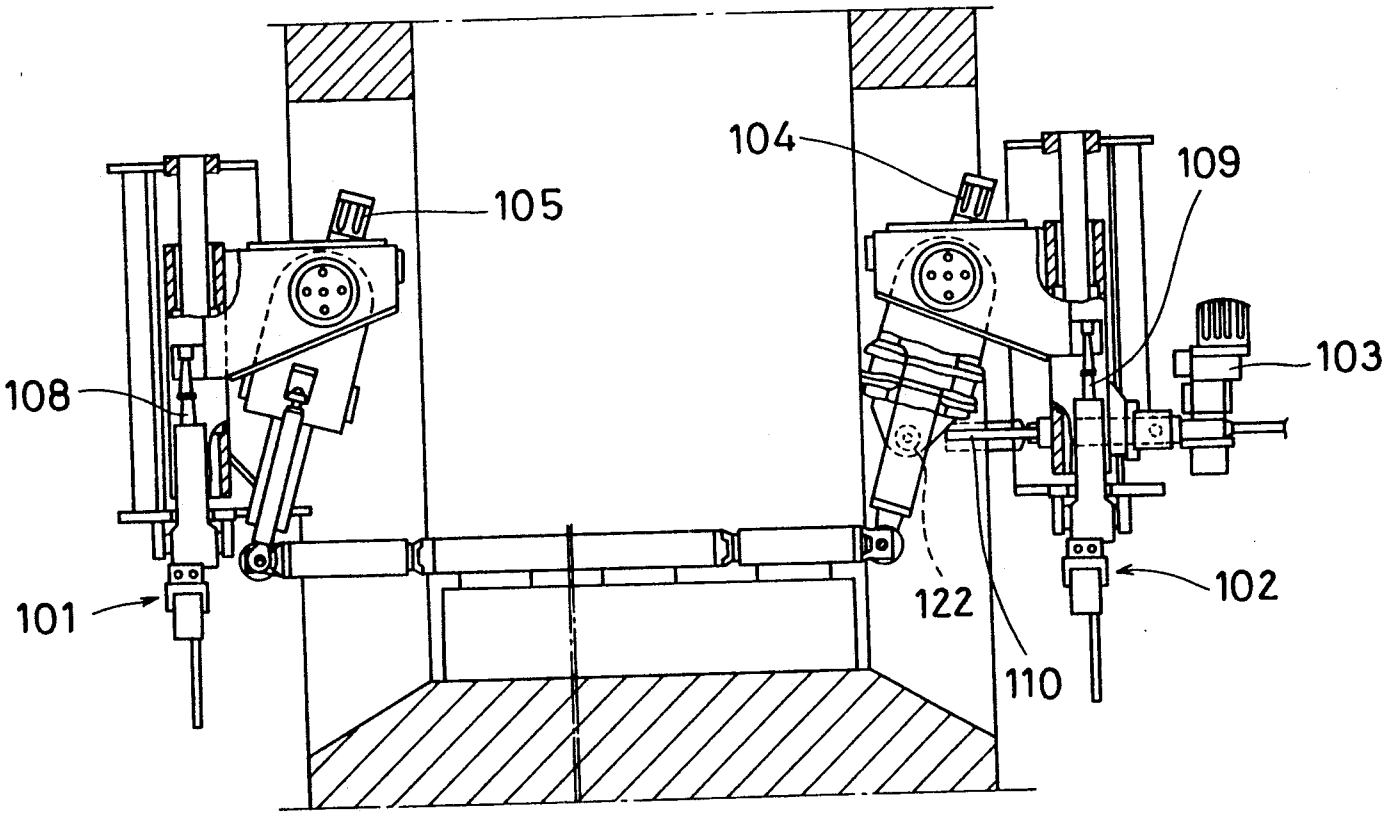
Fig. 10 Prior Art
FIG. 10 is a longitudinal sectional view showing a prior art construction.
Figure 11:
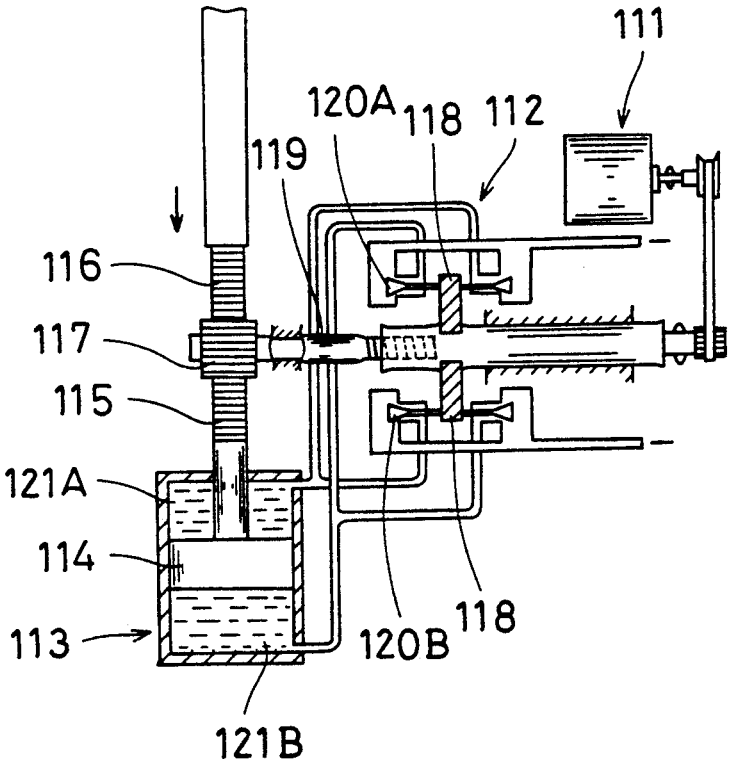
Fig. 11 Prior Art
FIG. 11 is a longitudinal view showing a part of the same prior art.

The input system comprises a keyboard 71 and a floppy disk unit into which a floppy disk programmed with patterns of transfer motions is set when such a floppy disk is to be used, and thus it is possible to preliminarily standardize and classify the required motions into several patterns thereby establishing initial operating conditions to be inputted. It is also possible to input special items other than those preliminarily classified by manual operation of the keyboard. These input data are delivered to the CPU through the IF to be processed and stored in predetermined regions of the RAM. The data are also subject to picture processing in the CPU and outputted to a display circuit to be displayed on a CRT 72 in the form of a graphic diagram and numeric values representing the operation. An example of such a display is shown in FIGS. 8 and 9, and in which data displayed in FIG. 8 was obtained by inputting the set values in FIG. 9 to the CPU 73 manually by the keyboard 71. The actual picture of the respective lines of operation is color-coded. In FIG. 8, numeral 81 indicates a press operation diagram, numeral 82 indicates a feed operation diagram, numeral 83 indicates a lift operation and 84 indicates a clamp operation diagram.

These diagrams represent a kind of simulation from which timing of respective operations can be appropriately acknowledged. When setting a stroke length (distance) and starting and ending times (or angles), the CPU (microcomputer) generates pulse signals according to a velocity curve for soft start and soft stop of operations in three directions. It is a matter of course that every numeric value to be fed back and inputted again after inputting to the CPU and driving the related sections, is subject to a required D/A conversion to be transmitted to the CPU in a bivalent form through the IF.

As the present invention may be made in several forms without departing from the spirit and scope thereof, it is to be understood that the invention is not limited to the specific embodiment thereof except as defined in the appended claims.

What is claimed is:

1. An automatic transfer apparatus for use in a forging press including an upper mold and a lower mold and control equipment for generating pulse signals controlling the operation of the forging press and movement of the transfer apparatus, the apparatus comprising a pair of beam drivers arranged spaced apart from each other on opposite sides of the molds and an external frame fixed to the forging press, said beam drivers being mounted for movement to said external frame, each beam driver comprising:

a hollow, square-shaped intermediate frame;

means mounting the intermediate frame to said external frame for vertical movement relative to said external frame;

a clamp frame for clamping a workpiece and moving the workpiece to and from the molds;

means mounting each clamp frame within its respective intermediate frame for movement relative to said external frame and in a lateral direction along a straight line path normal to the direction of movement of the intermediate frame;

a pair of beams for engaging the workpiece within the molds and mounted on each clamp frame for movement by one of said clamp frames relative to the external frame and said intermediate frame; and a plurality of servo motors each directly controlled by the pulse signals and each servo motor arranged for effecting, respectively, the vertical movement of said intermediate frame, the lateral movement of each clamp frame and the relative movement of said pair of beams, said plurality of servo motors being controlled to operate and stop by the control equipment.

2. The automatic transfer apparatus according to claim 1, wherein said means mounting the intermediate frame to said external frame comprises:

a pair of spaced apart lift guides fixed to the intermediate frame;

a lateral member connected between said lift guides, said lateral member having an opening defining female threads; and a threaded screw connected for rotation to one of said servo motors and engageable with the female threads in the opening in said lateral member, said threaded screw imparting the vertical movement to said intermediate frame through said lateral member and lift guides.

3. The automatic transfer apparatus according to claim 1, wherein said means mounting the clamp frame within said intermediate frame comprises:

a threaded feed shaft mounted at one end to said intermediate frame and connected for rotation to one of said servo motors;

a pair of feed guide rods spaced apart, mounted to said intermediate frame and extending through said clamp frame, said pair of feed guide rods and threaded feed shaft extending parallel to each other; and means defining a female screw thread on said clamp frame, said female screw thread threadedly engaging the threaded feed shaft for movement of said clamp frame relative to said pair of feed guide rods and said intermediate frame.

4. The automatic transfer apparatus according to claim 1, wherein each clamp frame comprises:

a slide having a female screw thread defined therein;

a threaded clamp shaft;

means mounting each end of said threaded clamp shaft and a servo motor at one end of said threaded clamp shaft for rotating said threaded clamp shaft;

said threaded clamp shaft threadedly engaging the female screw thread of said slide for movement of said slide relative to said threaded clamp shaft; and linkage means rotatably mounted to said slide for turning said pair of beams.

5. The automatic transfer apparatus according to claim 1, further comprising:

a servo motor mounted to the external frame adjacent each intermediate frame;

a servo motor mounted to one of said intermediate frames;

a servo motor mounted to each clamp frame, wherein said means mounting the intermediate frame to the external frame includes a threaded screw connected to a respective servo motor, said means mounting each clamp frame within its respective intermediate frame includes a threaded feed shaft connected to a servo motor, and each clamp frame comprises a threaded clamp shaft and a servo motor for rotating said threaded clamp shaft.

6. The automatic transfer apparatus according to claim 1, wherein the control equipment comprises:

a CPU;

a servo controller connected to the CPU and a respective servo motor;

a pulse generator connected to each servo controller and each servo motor for generating feedback data to said servo controller;

an input unit for inputting an initial condition of the servo motors to said CPU; and a display unit connected to the CPU, wherein the CPU compares the data input by the input unit to the feedback data received from each pulse generator and generates a signal displayed by said display unit and received by the respective servo motor for operating said servo motors.

7. The automatic transfer apparatus according to claim 6, wherein the control equipment further comprises:

a synchronous detector connected between adjacent servo controllers and to said CPU for generating a signal when adjacent servo motors are operating in synchronism and a different signal when they are not.

8. The automatic transfer apparatus according to claim 2, wherein said means mounting the clamp frame within said intermediate frame comprises:

a threaded feed shaft mounted at one end to said intermediate frame and connected for rotation to one of said servo motors;

a pair of feed guide rods spaced apart, mounted to said intermediate frame and extending through said clamp frame, said pair of feed guide rods and threaded feed shaft extending parallel to each other; and means defining a female screw thread on said clamp frame, said female screw thread threadedly engaging the threaded feed shaft for movement of said clamp frame relative to said pair of feed guide rods and said intermediate frame.

9. The automatic transfer apparatus according to claim 2, wherein each clamp frame comprises:

a slide having a female screw thread defined therein;

a threaded clamp shaft;

means mounting each end of said threaded clamp shaft and a servo motor for rotating said threaded clamp shaft;

said threaded clamp shaft threadedly engaging the female screw thread of said slide for movement of said slide relative to said threaded clamp shaft; and linkage means rotatably mounted to said slide for turning said pair of beams.

10. The automatic transfer apparatus according to claim 2, further comprising:

a servo motor mounted to the external frame adjacent each intermediate frame;

a servo motor mounted to one of said intermediate frames;

a servo motor mounted to each clamp frame, wherein:

said means mounting each clamp frame within its respective intermediate frame includes a threaded feed shaft connected to a servo motor, and each clamp frame comprises a threaded clamp shaft and a servo motor for rotating said threaded clamp shaft.

11. The automatic transfer apparatus according to claim 2, wherein the control equipment comprises:

a CPU;

a servo controller connected to the CPU and a respective servo motor;

a pulse generator connected to each servo controller and each servo motor for generating feedback data to said servo controller;

an input unit for inputting an initial condition of the servo motors to said CPU; and a display unit connected to the CPU, wherein the CPU compares the data input by the input unit to the feedback data received from each pulse generator and generates a signal displayed by said display unit and received by the respective servo motor for operating said servo motors.

12. The automatic transfer apparatus according to claim 11, wherein the control equipment further comprises:

a synchronous detector connected between adjacent servo controllers and to said CPU for generating a signal when adjacent servo motors are operating in synchronism and a different signal when they are not.

13. The automatic transfer apparatus according to claim 4, wherein said means mounting the clamp frame within said intermediate frame comprises:

a threaded feed shaft mounted at one end to said intermediate frame and connected for rotation to one of said servo motors; and a pair of feed guide rods spaced apart, mounted to said intermediate frame and extending through said clamp frame, said pair of feed guide rods and threaded feed shaft extending parallel to each other.

14. The automatic transfer apparatus according to claim 4, further comprising:

a servo motor mounted to the external frame adjacent each intermediate frame;

a servo motor mounted to one of said intermediate frames;

a servo motor mounted to each clamp frame, wherein said means mounting the intermediate frame to the external frame includes a threaded screw connected to a respective servo motor, and said means mounting each clamp frame within its respective intermediate frame includes a threaded feed shaft connected to a servo motor.

15. The automatic transfer apparatus according to claim 4, wherein the control equipment comprises:

a CPU;

a servo controller connected to the CPU and a respective servo motor;

a pulse generator connected to each servo controller and each servo motor for generating feedback data to said servo controller;

an input unit for inputting an initial condition of the servo motors to said CPU; and a display unit connected to the CPU, wherein the CPU compares the data input by the input unit to the feedback data received from each pulse generator and generates a signal displayed by said display unit and received by the respective servo motor for operating said servo motors.

16. The automatic transfer apparatus according to claim 15, wherein the control equipment further comprises:

a synchronous detector connected between adjacent servo controllers and to said CPU for generating a signal when adjacent servo motors are operating in synchronism and a different signal when they are not.

17. The automatic transfer apparatus according to claim 4, wherein said means mounting the clamp frame within said intermediate frame comprises:

a threaded feed shaft mounted at one end to said intermediate frame and connected for rotation to one of said servo motors; and a pair of feed guide rods spaced apart, mounted to said intermediate frame and extending through said clamp frame, said pair of feed guide rods and threaded feed shaft extending parallel to each other.

18. The automatic transfer apparatus according to claim 4, further comprising:

a servo motor mounted to the external frame adjacent each intermediate frame;

a servo motor mounted to one of said intermediate frames;

a servo motor mounted to each clamp frame, wherein said means mounting the intermediate frame to the external frame includes a threaded screw connected to a respective servo motor, and said means mounting each clamp frame within its respective intermediate frame includes a threaded feed shaft connected to a servo motor.

19. The automatic transfer apparatus according to claim 4, wherein the control equipment comprises:

a CPU;

a servo controller connected to the CPU and a respective servo motor;

a pulse generator connected to each servo controller and each servo motor for generating feedback data to said servo controller;

an input unit for inputting an initial condition of the servo motors to said CPU; and a display unit connected to the CPU, wherein the CPU compares the data input by the input data to the feedback data received from each pulse generator and generates a signal displayed by said display unit and received by the respective servo motor for operating said servo motors.

20. The automatic transfer apparatus according to claim 19, wherein the control equipment further comprises:

a synchronous detector connected between adjacent servo controllers and to said CPU for generating a signal when adjacent servo motors are operating in synchronism and a different signal when they are not.

* * * * *